US005584684A

United States Patent [19]

Dobbeling et al.

[11] Patent Number: 5,584,684

[45] Date of Patent: Dec. 17, 1996

[54] COMBUSTION PROCESS FOR ATMOSPHERIC COMBUSTION SYSTEMS

[75] Inventors: Klaus Döbbeling, Nussbaumen; Hans P. Knöpfel, Besenbüren; Thomas Sattelmayer, Mandach, all of Switzerland

[73] Assignee: ABB Management AG, Baden, Switzerland

[21] Appl. No.: 415,210

[22] Filed: Mar. 31, 1995

[30] Foreign Application Priority Data

May 11, 1994 [DE] Germany ..... 44 16 650.8

[51] Int. Cl.[6] ..... F23Q 9/00

[52] U.S. Cl. ..... 431/285; 431/8; 431/9; 431/353; 60/746; 60/747; 60/733

[58] Field of Search ..... 60/746, 747, 733; 431/8, 285, 353, 9

[56] References Cited

U.S. PATENT DOCUMENTS

| | | | |
|---|---|---|---|
| 2,930,192 | 3/1960 | Johnson | 60/746 |
| 4,910,957 | 3/1990 | Moreno et al. | 60/746 |
| 4,932,861 | 6/1990 | Keller et al. | 431/8 |
| 5,054,280 | 10/1991 | Ishibashi et al. | 60/733 |
| 5,069,029 | 12/1991 | Kuroda et al. | 60/733 |
| 5,121,597 | 6/1992 | Urushidani et al. | 60/747 |
| 5,201,650 | 4/1993 | Johnson | 431/285 |
| 5,284,438 | 2/1994 | McGill et al. | 431/8 |

FOREIGN PATENT DOCUMENTS

| | | |
|---|---|---|
| 3545524A1 | 7/1987 | Germany . |
| 3707773A1 | 9/1988 | Germany . |
| 671449 | 8/1989 | Switzerland . |

*Primary Examiner*—Carroll B. Dority
*Attorney, Agent, or Firm*—Burns, Doane, Swecker & Mathis, L.L.P.

[57] ABSTRACT

In the case of a heat generator which essentially consists of a premix burner (100) and a flame tube (1), the hot gases (10) from the combustion in the premix burner (100) are fed into the flame tube (1), and there undergo staged post-combustion. This post-combustion takes place by means of a first post-combustion stage (11) and a second post-combustion stage (12). The air/fuel mixture (11*a*, 12*a*) is provided for each post-combustion stage (11, 12) in individual mixers (200, 300). These mixers are arranged axially with respect to the flame tube (1) and work in such a way that injection of the corresponding mixture (11*a*, 12*a*) makes it possible to obtain different combustion zones which extend in a staged sequence over the flame tube (1). By virtue of this staged post-combustion mode $NO_x$ emissions can be reduced by a factor of 5 compared to conventional techniques.

6 Claims, 5 Drawing Sheets

COMBUSTION PROCESS FOR ATMOSPHERIC COMBUSTION SYSTEMS

FIELD OF THE INVENTION

The present invention relates to a combustion apparatus apparatus for an atmospheric combustion system for atmospheric combustion systems for reducing $No_x$ emissions process.

DISCUSSION OF BACKGROUND

In the case of conventional combustion processes using a premixing technique, the lower limit of the nitrogen oxide ($NO_x$) production is predetermined by the weak extinction limit which is at an a diabetic flame temperature of approximately 1600K. Under gas turbine conditions, $NO_x$ discharges of approximately 7–10 ppm (15% $O_2$) can typically be reached in this range. The desire to make the mixture even leaner leads to flame extinction. In practice, especially in transient regions, it is, however, necessary to retain a certain distance from the extinction limit, so that flame temperatures of below 1650K cannot be reached for operational reasons. The result of this is that further decrease of the $NO_x$ emissions is therefore prevented.

SUMMARY OF THE INVENTION

The invention remedies this situation. The object of the invention is, in the case of a device of the type mentioned at the outset, to propose precautions which are capable of further lowering the $NO_x$ emissions.

The invention is based on the fact that it is possible to burn fuel with a much lower flame temperature if such a fuel is injected into hot gases. The same effect can also be obtained if, for example, a premixed fuel/air mixture is used. In combustion chambers, self-ignition occurs at a mixture rate of approximately 1 $ms^1$, this being when the mixture of fuel, air, and, if necessary, combustion gases reaches a temperature of the order of magnitude of 900°–950° C.

A burner operating according to a premixing principle is used in a first stage for generating hot gases. However, only a portion of the available or required air and fuel, for example 15–30%, is fed to this premix burner. In this case the optimum operating point is set near the extinction limit in the case of the premix burner. After most of the air/fuel mixture has reacted inside the premix burner, an additional air/fuel mixture which has previously been prepared in a system of mixers is injected into the hot gases.

The latter mixture prepared in the mixers should per se be leaner than the mixture for operating the premix burner. It may, however, also be logical to form richer mixtures, especially whenever the premix burner is operating unsatisfactorily with respect to its $NO_x$ production. Mixing in the mixture from the mixers into the hot gases from the premix burner triggers self-igniting post-combustion.

The ratio of the mass flow injected via the mixers to the mass flow of the hot gases from the premix burner should not exceed a certain ratio, in order to guarantee fast ignition of the fuel used for the post-combustion. A value of 1.5 should preferably be provided in this case. It is, however, not necessary for the temperature absolutely to reach the above-mentioned 900°–950° C. before the start of the post-combustion, the reason for this being because the reaction is generally already initiated during the mixing in and a portion of the thermal value of the post-combustion fuel has already been converted, before this mixing in is completed. It is favorable to carry out the post-combustion in a plurality of stages: the above-specified 15–30% corresponds to a two-stage process, because in this case a higher proportion of the fuel used for the post-combustion can be fed in. Injection for the second post-combustion stage may occur early. Although the majority of the mixture from the first post-combustion stage has already reacted at this point, there are, however, still high CO concentrations. In order to obtain fast burning up of CO after the last stage and therefore a short combustion chamber, it is logical to inject proportionately less mixture as the stage number increases. This occurs, for example, automatically if the same absolute flow quantity is fed from stage to stage.

The essential advantage of the invention resides in the fact that an $NO_x$ abatement potential of a factor of 5 compared to the best known premix technique is thereby produced.

Another essential advantage of the invention resides in the fact that the statements above are also valid for fuels from gasification processes. Although it is true that these fuels have a high hydrogen content and therefore ignite very rapidly, their flame speed and the volumetric reaction density being very high, more can be injected in a post-combustion stage because ignition is in this case unproblematic even at very low exhaust-gas temperatures. In such a case the premix burner can therefore be designed very small upstream.

Advantageous and expedient developments of the solution to the object of the invention are characterized in the later claims.

Exemplary embodiments of the invention will be explained in detail hereinbelow with the aid of the drawings. All elements not necessary for direct understanding of the invention are omitted. The flow direction of the various media is specified with arrows. The same elements in the various figures are provided with the same references.

DETAILED DESCRIPTION

Figure 1:
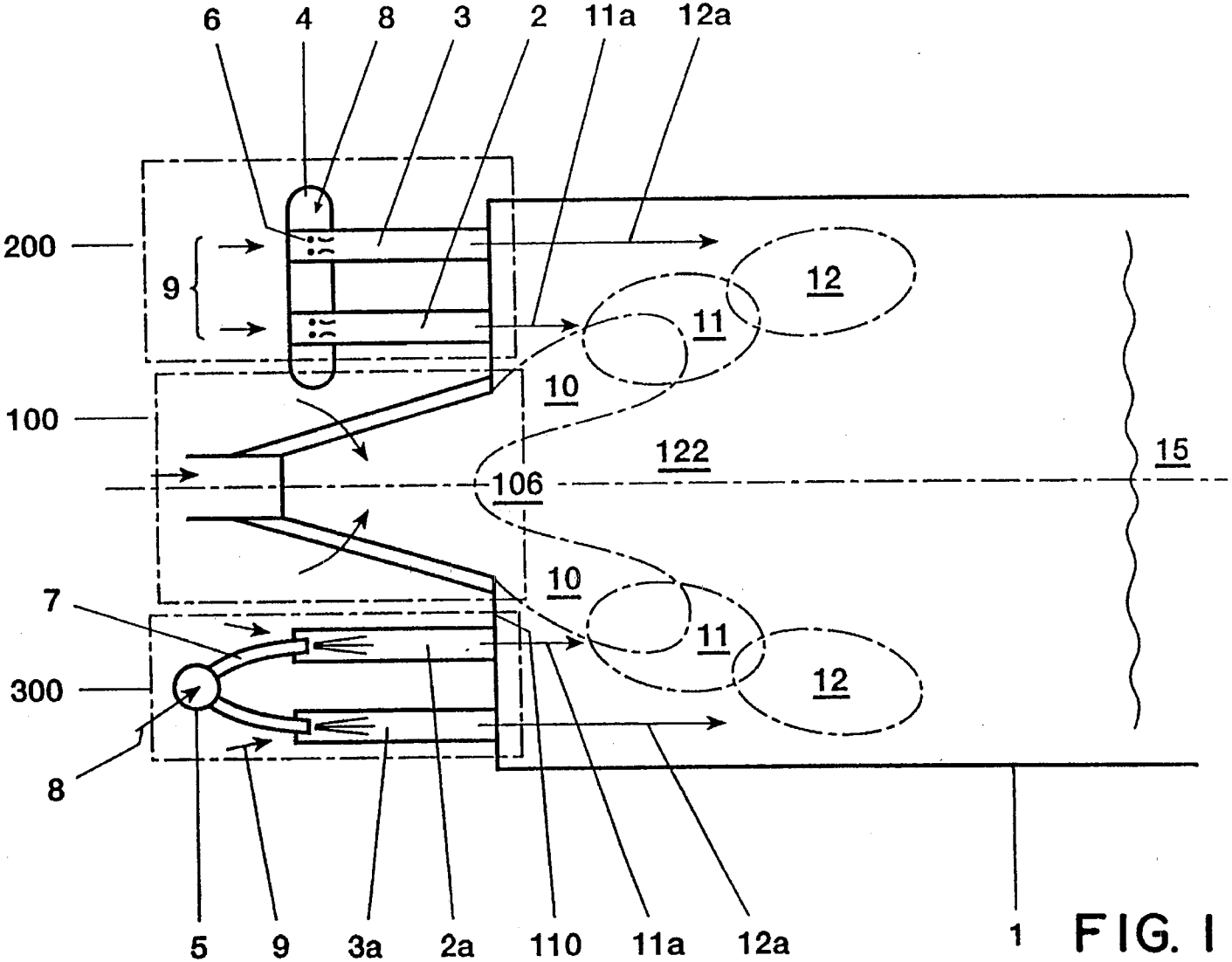
FIG. 1 shows a heat generator having a premix burner and an axial combustion sequence.

FIG. 1 shows a heat generator. It consists of a premix burner 100 which will be dealt with in more detail later, followed in the flow direction by a flame tube 1 which, for its part, extends over the entire combustion chamber 122. A boiler, not shown, of the heat generator is on the downstream side of the flame tube 1. The heat generator furthermore has a system of devices 200, 300 for operating post-combustion zones which act axially with respect to the flame tube 1 and in the plane of the premix burner 100 and in which an air and fuel mixture prepared in the devices is burned. These devices 200, 300 have the function of converting air and fuel into a mixture. It is advantageous, as will be discussed in more detail hereinbelow, to carry out the post-combustion in a plurality of stages and a two-stage post-combustion is shown here. The said plane is largely formed by the front wall 110 of the premix burner 100. The post-combustion devices 200, 300, i.e. the mixers, act in the cross-sectional broadening between the flame aperture of the premix burner 100 and the flow cross-section of the flame tube 1. The premix burner 100 is first used as an initial combustion stage 10 for generating hot gases. However, only a portion of the available or possible air and of the fuel, for example 15–30%, is fed to this premix burner 100. The optimum operating point is in this case set near the extinction limit. After most of the mixture from the premix burner 100 has reacted, another air/fuel mixture 11*a*, 12*a*, which has previously been prepared in the mixers 200, 300, is injected into the hot gases 10 downstream of the premix burner 100. This mixture 11*a*, 12*a* is kept leaner than the mixture for operating the premix burner 100. Mixing in the mixtures 11*a*, 12*a* from the mixers 200, 300 with the hot gases 10 from the premix burner 100 triggers corresponding self-igniting post-combustions 11, 12 which develop and follow one another in stages in the flow direction within the flame tube 1, concentrically about a counterflow zone 106 formed by the premix burner 100. On the basis that the flame front of the hot gases 10 from the premix burner 100 forms the primary combustion zone, then the post-combustion 11 with the mixture 11*a* forms the secondary combustion zone, which is adjacent to the primary combustion zone 10 in the radial direction. Another post-combustion 12 with the mixture 12*a* follows as the tertiary combustion zone, the radial boundary of which is the internal wall of the flame tube 1. The vortex initiated by the reverse flow zone 106 also influences the subsequent combustion zones, as symbolically expressed by the figure. As regards the mixers 200, 300, they are distinguished from one another as regards the medium for forming the mixture. The mixer 200 consists of a tube system 2, 3, the number of which corresponds to the number of combustion zones. The individual tubes 2, 3 emerge upstream in an annular space 4, out of which a gaseous fuel 8 flows via bores 6 into the corresponding tubes 2, 3. For its part, air 9 also flows, preferably axially, into the tubes 2, 3 and is enriched by the fuel 8, preferably a gaseous fuel, flowing in radially, whereupon each mixture 11*a*, 12*a* which triggers the self-igniting post-combustion in the flame tube 1 is formed within the length of the tubes 2, 3. These tubes consequently fulfill the function of a premix section. Similar considerations hold in the case of the other mixer 300. The essential difference here resides in the fact that the fuel 8 is supplied via an annular line 5 and corresponding branches 7 from this annular line 5 produce the injection of the fuel 8 into the tubes 2*a*, 3*a*. In this case the air 9 for forming the mixture likewise flows into the individual tubes 2*a*, 3*a*. The ratio of the mass flow injected into the flame tube 1 via the mixers 200, 300 to the mass flow 10 from the premix burner 100 should not exceed a certain ratio, in order to guarantee rapid ignition of the mixtures 11*a*, 12*a*. A ratio of 1.5 between the two should preferably be used as a basis here. The temperature of the hot gases 10 from the premix burner 100 when using the self-igniting post-combustion need not necessarily reach the above-mentioned 900°–950° C., because this reaction is in general already initiated during the mixing, and a portion of the thermal value of the fuel 8 used in the post-combustion is already converted before the mixing is completed. As already mentioned hereinabove, it is favorable to carry out the post-combustion in a plurality of stages. The above-cited value of 15–30% regarding air and fuel proportion relates to the two-stage process. In such a case a higher proportion of the fuel 8 employed may be fed to the two post-combustion stages, and thus to the secondary and tertiary combustion zones 11, 12. In order to obtain a fast CO burn-off 15 after the last stage, and therefore a short combustion chamber, it is necessary for a proportionately ever-decreasing amount of mixture 11*a*, 12*a* to be injected with increasing stage number. This is achieved if the same absolute quantity of mixture is fed in, from stage to stage, and therefore from combustion zone to combustion zone. A heat generator operated in such a manner reduces the $NO_x$ emissions in comparison with the prior art by a factor of 5.

Figure 2:
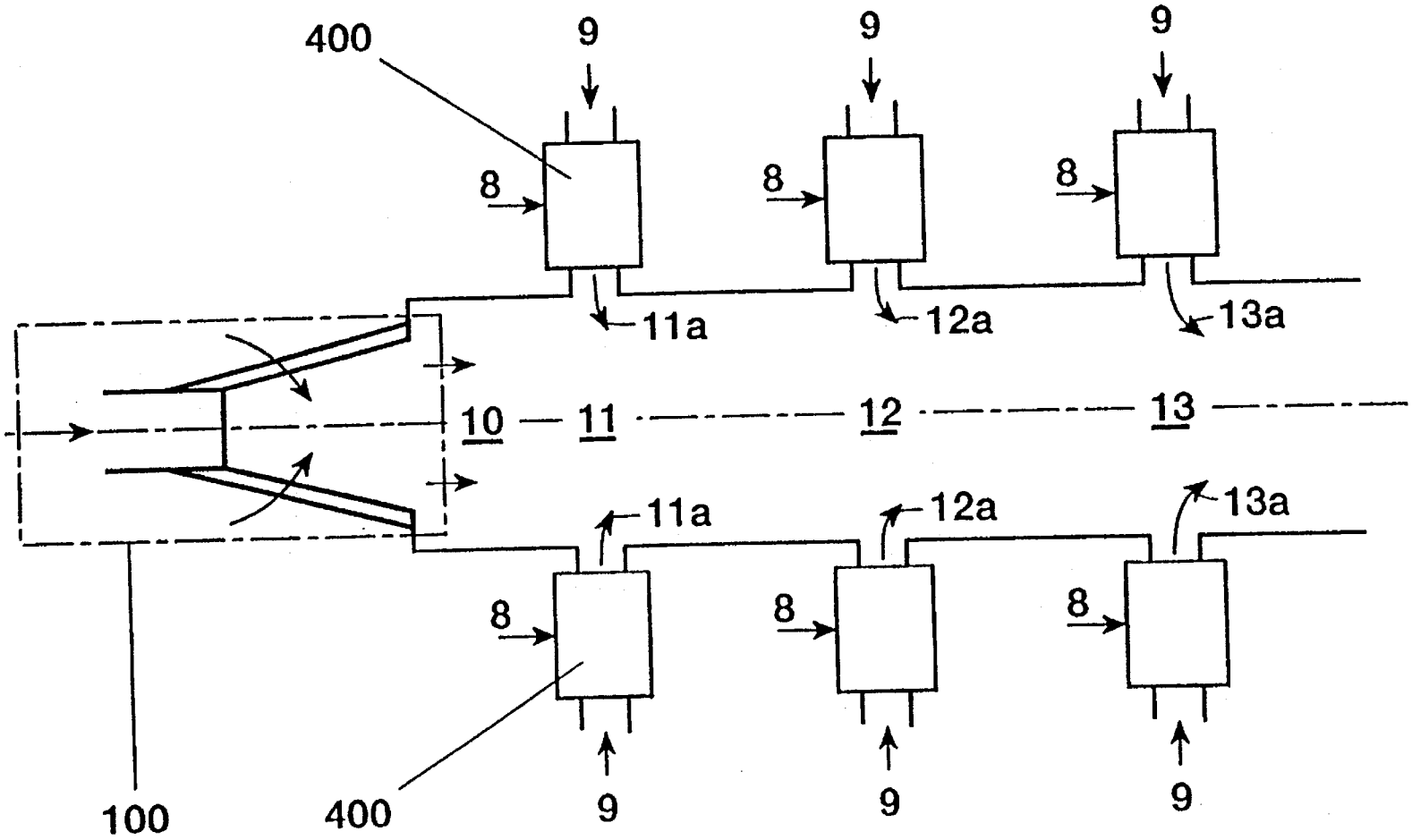
FIG. 2 shows another heat generator having a premix burner and a radial combustion sequence.

In FIG. 2, the post-combustion zones act radially with respect to the flame tube 14, so that the flame tube 14 employed in this case is elongated. The same premix burner 100 also acts in this case upstream of the flame tube 14. Three other post-combustion stages 11, 12, 13 act after the primary combustion zone 10. At least two mixers 400, in which air 9 and fuel 8 are processed to form a mixture 11*a*, 12*a*, 13*a*, are assigned to each stage.

A plurality of mixers 400 may obviously be arranged on the circumference of the flame tube 14; the same is also true in the case of the other mixers 200, 300 in FIG. 1, a specified number of which are distributed around the premix burner 100. It is furthermore also possible to operate the post-combustion zones using a combination of axially/radially arranged mixers. The embodiment according to FIG. 2 is preferably suitable for retrofit applications.

Figure 3:
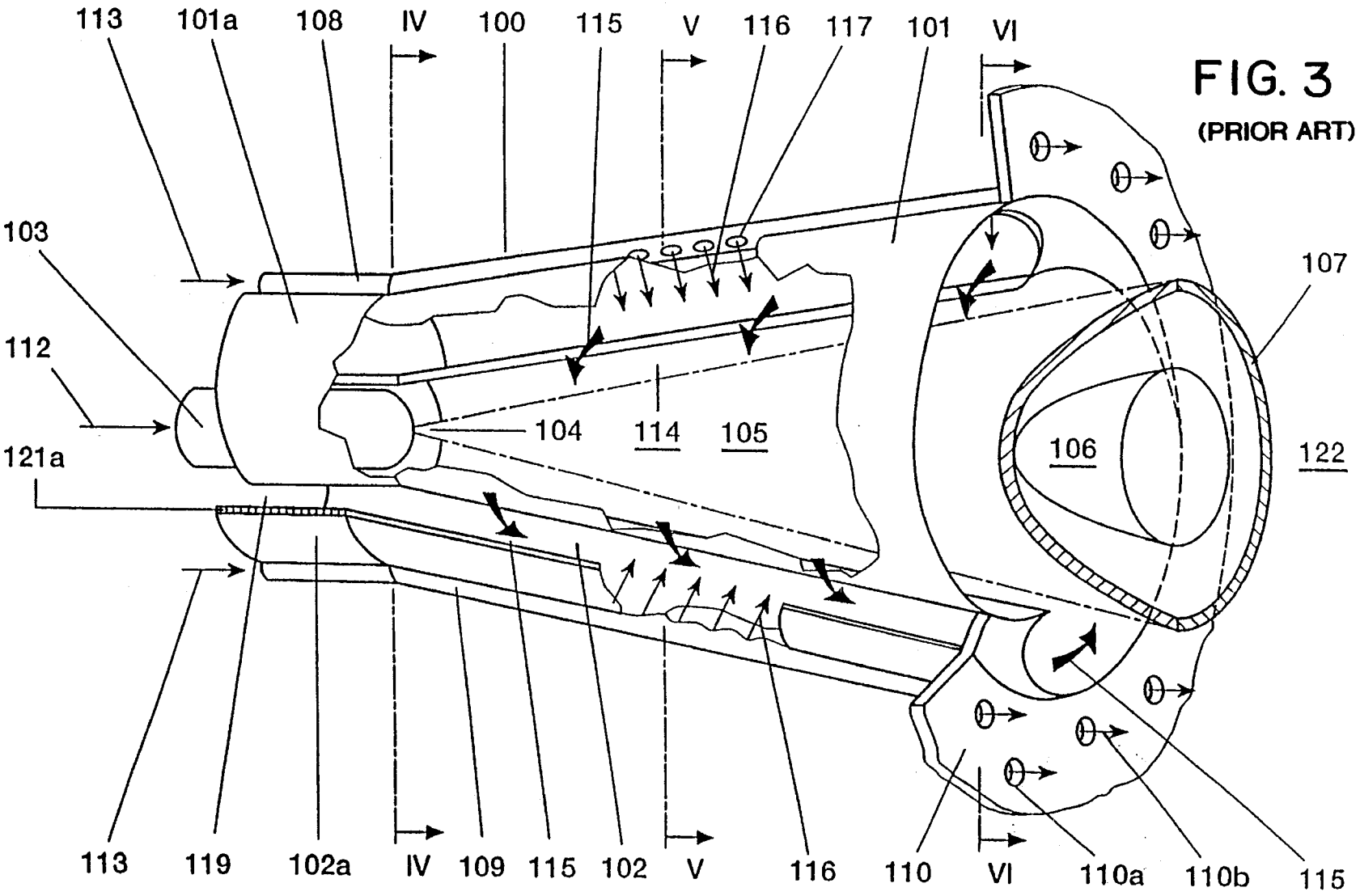
FIG. 3 (PRIOR ART)
FIG. 3 shows a premix burner in the embodiment as a "double-cone burner" in perspective representation, accordingly cut-away.
Figure 4:
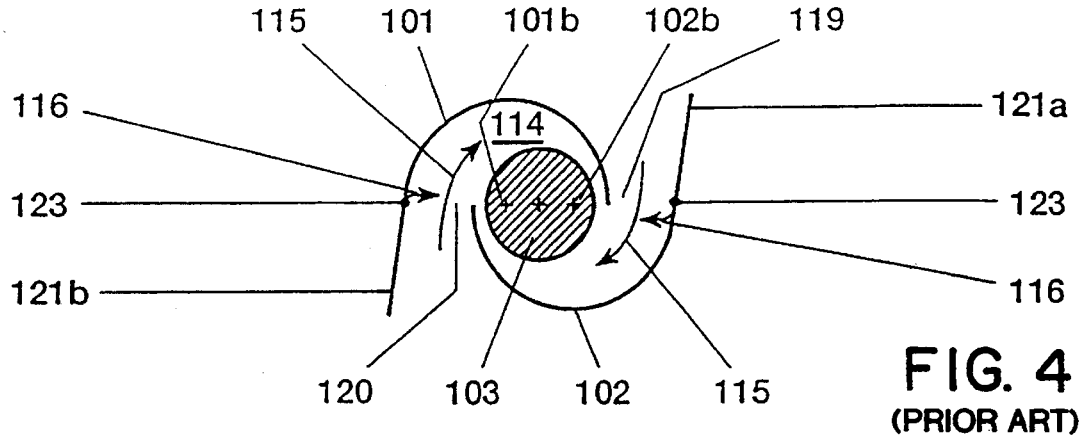
FIG. 4 (PRIOR ART)
FIGS. 4–6 show corresponding sections through various planes of the burner according to FIG. 3.
Figure 5:
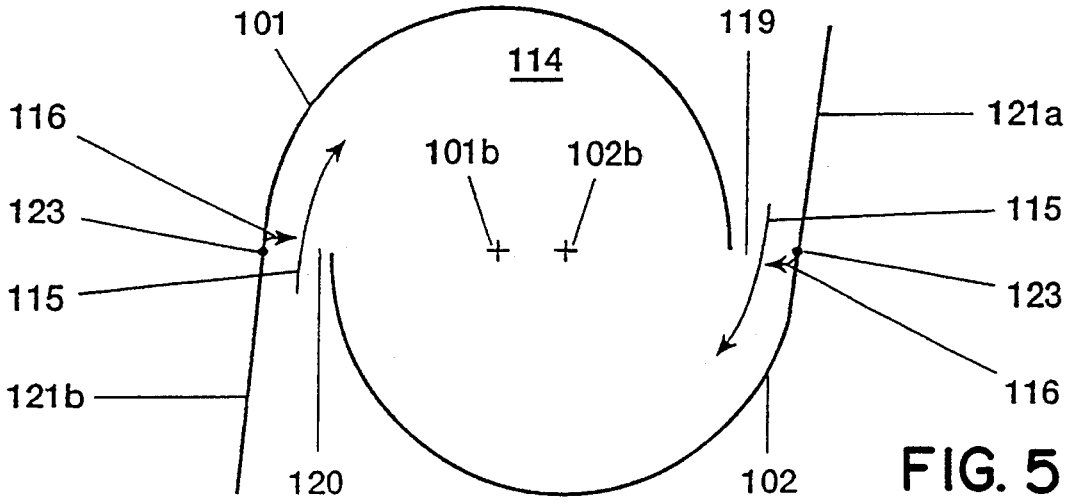
FIG. 5 (PRIOR ART)
Figure 6:
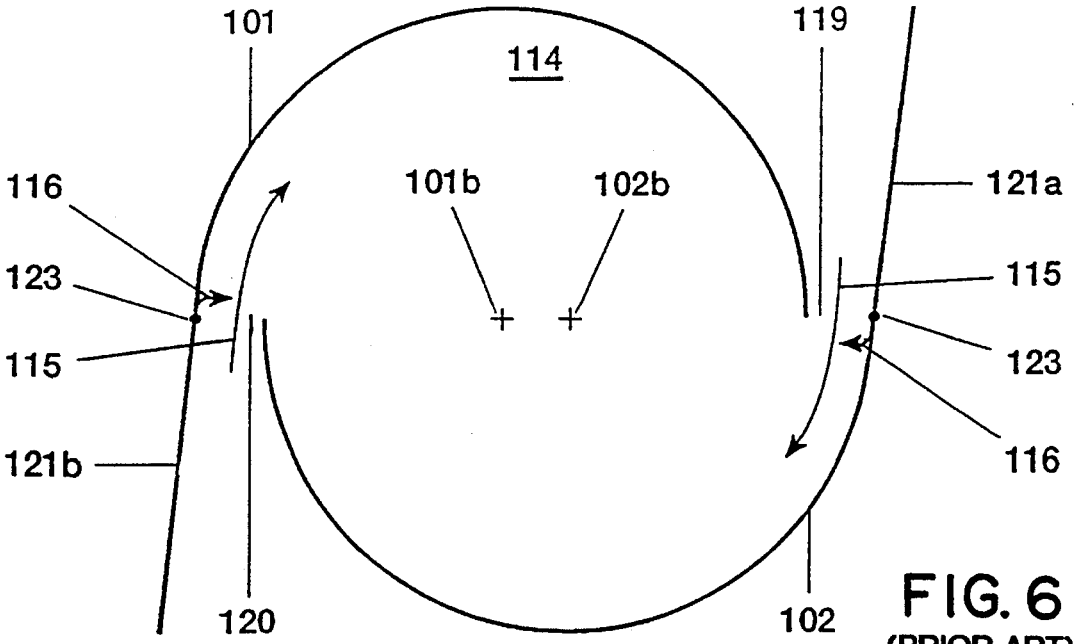
FIG. 6 (PRIOR ART)

In order better to understand the design of the burner 100, it is advantageous to refer to the individual sections according to FIGS. 4–6 simultaneously with FIG. 3. Furthermore, in order not to make FIG. 3 unnecessarily unclear, the guide plates 121*a*, 121*b* schematically shown according to FIGS. 4–6 are included therein only in the barest detail. In the description of FIG. 3 hereinbelow, reference is made to the remaining FIGS. 4–6 when necessary.

Figure 7:
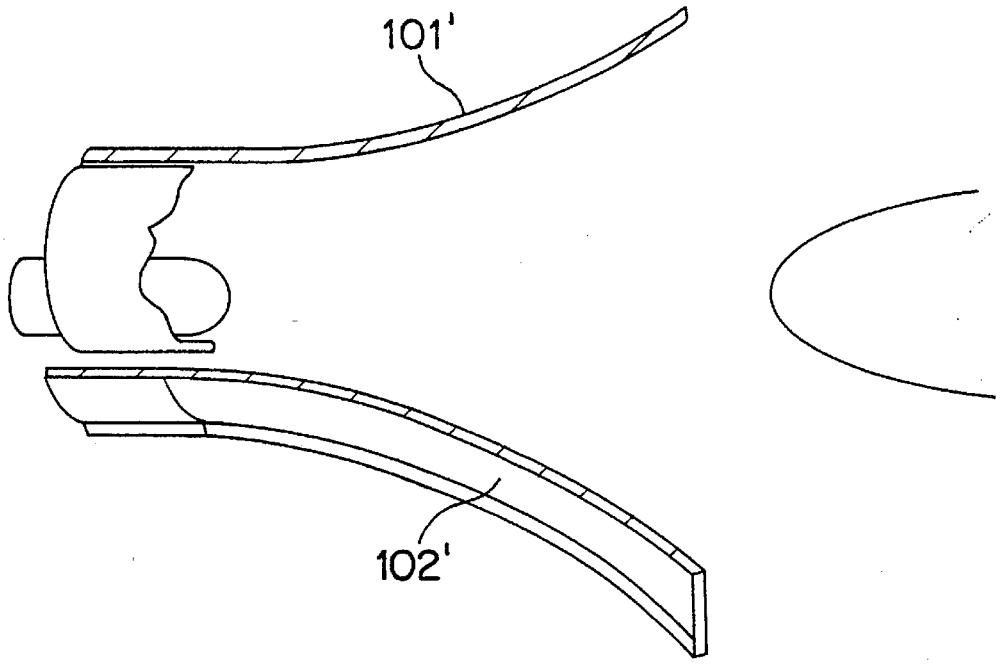
FIG. 7 illustrates a double-cone burner in which the burner bodies have a cone angle that increases in the flow direction.
Figure 8:
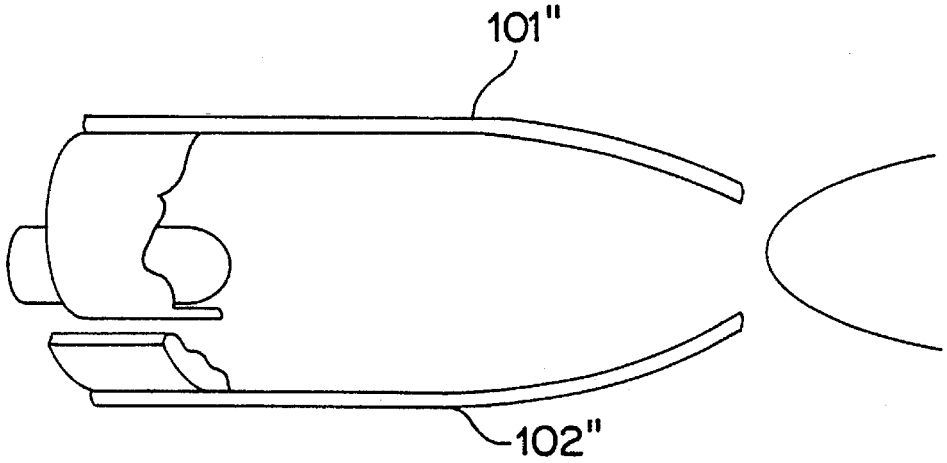
FIG. 8 illustrates a double-cone burner in which the burner bodies have a cone angle that decreases in the flow direction.

The burner 100 according to FIG. 3 is a premix burner and consists of two hollow conical partial bodies 101, 102 which are connected offset into one another. The offset with respect to one another of the corresponding central axis or longitudinal symmetry axes 201*b*, 202*b* of the conical partial bodies 101, 102 frees, on both sides, in mirror-symmetry arrangement, in each case one tangential air inlet slit 119, 120 (FIGS. 4–6), through which the combustion air 115 flows into the internal space of the burner 100, that is to say into the hollow conical space 114. The conical shape of the indicated partial bodies 101, 102 in the flow direction has a specific fixed angle. Obviously, depending on the operational use, the partial bodies may have an increasing 101', 102' or decreasing 101", 102" conicity in the flow direction, similar to a trumpet or tulip, as shown in FIG. 7 and FIG. 8 respectively.

The latter two shapes are not drawn since they can be readily reconstructed by the person skilled in the art. The two conical partial bodies 101, 102 each have a cylindrical initial part 101*a*, 102*a* which likewise, similarly to the conical partial bodies 101, 102, extend offset with respect to one another, so that the tangential air inlet slits 119, 120 are present over the entire length of the burner 100. A nozzle 103 is placed in the region of the cylindrical initial part, the injection 104 from which nozzle approximately coincides with the narrowest cross-section of the hollow conical space 114 formed by the conical partial bodies 101, 102. The injection capacity and the type of this nozzle 103 are governed the predetermined parameters of the corresponding burner 100. Obviously, the burner may be designed purely conically, thus without cylindrical initial parts 101*a*, 102*a*. The conical partial bodies 101, 102 furthermore each have a fuel line 108, 109 which are arranged along the tangential inlet slits 119, 120 and are provided with injection orifices 117, via which, preferably, a gaseous fuel 113 is injected into the combustion air 115 flowing therethrough, as the arrows 116 are intended to symbolize. These fuel lines 108, 109 are preferably placed before or, at the latest, at the end of the tangential inflow, before entry into the hollow conical space 114, in order to keep the latter at an optimum air/fuel mixture. On the combustion chamber side 122 the outlet aperture of the burner 100 runs into a front wall 110, in which a number of bores 110*a* are present. The latter are caused to operate according to need, and their purpose is to ensure that dilution air or cooling air 110*b* is fed to the front part of the combustion chamber 122. This air feed furthermore serves to provide flame stabilization at the outlet of the burner 100. This flame stabilization becomes important whenever it is necessary to support the compactness of the flame as a result of radial flattening. For its part, the fuel supplied through the nozzle 103 is a liquid fuel 112 which may, if necessary, be enriched with a fed-back combustion gas. This fuel 112 is injected at an acute angle into the hollow conical space 114. A conical fuel profile 105 is therefore formed from the nozzle 103, which profile is enclosed by the rotating combustion air 115 flowing in tangentially. The concentration of the fuel 112 is continuously decreased in the axial direction by the combustion air 115 flowing in, to give optimum mixing. If the burner 100 is operated using a gaseous fuel 113, then this is preferably carried out by introduction via aperture nozzles 117, formation of this fuel/air mixture occurring directly at the end of the air inlet slits 119, 120. When the fuel 112 is injected via the nozzle 103, the optimum homogeneous fuel concentration over the cross-section is obtained in the region of the vortex site, thus in the region of the reverse flow zone 106 at the end of the burner 100. Ignition takes place at the tip of the reverse flow zone 106. Only here can a stable flame front 107 be produced. There is in this case no risk of blowback of the flame into the interior of the burner 100, as is intrinsically the case with known premix sections, as a result of which remedy is sought using complicated flame holders. If the combustion air 115 is additionally preheated or enriched with a fed-back combustion gas, then this continuously promotes evaporation of the liquid fuel 112, before the combustion zone is reached. The same considerations are also valid if, instead of gaseous, liquid fuels are fed via the lines 108, 109. In the design of the conical partial bodies 101, 102, tight limits are to be retained with regard to cone angle and width of the tangential air inlet slits 119, 120, in order for it to be possible for the desired flow field of the combustion air 115 with the flow zone 106 to be set up at the outlet of the burner. It should generally be stated that making the tangential air inlet slits 119, 120 smaller shifts the reverse flow zone 106 further upstream, although the mixture then consequently ignites earlier. In any case, it should be established that, once the reverse flow zone 106 is fixed, it is stable in its position, since the spin rate increases in the flow direction in the region of the conical shape of the burner 100. The axial velocity within the burner 100 can be changed by a corresponding feed, not shown, of an axial combustion air flow. The design of the burner 100 is furthermore preferably suitable for changing the size of the tangential air inlet slits 119, 120, by means of which a relatively wide operating range can be covered without altering the overall length of the burner 100.

The geometrical configuration of the guide plates 121*a*, 121*b* is now given by FIGS. 4–6. They have a flow introduction function and, corresponding to their length, they extend the corresponding end of the conical partial bodies 101, 102 in the inlet-flow direction with respect to the combustion air 115. The channelling of the combustion air 115 into the hollow conical space 114 can be optimized by opening or closing the guide plates 121*a*, 121*b* around a pivot point 123 placed in the region of the inlet of this channel into the hollow conical space 114, this being particularly necessary if the original gap size of the tangential air inlet slits 119, 120 is changed. These dynamic precautions may obviously also be provided in the steady state, in that tailored guide plates form a fixed component with the conical partial bodies 101, 102. The burner 100 can likewise also be operated without guide plates, or other auxiliary means may be provided for this purpose.

What is claimed is:

1. Device for carrying out a combustion process for atmospheric combustion systems, comprising:

a premix burner comprising at least two hollow conical-section bodies disposed to define a conical hollow space having a longitudinal axis parallel to a flow direction of the burner, respective longitudinal symmetry axes of the bodies being offset with respect to one another so that mutually adjacent walls of the bodies form channels along the longitudinal direction for a tangentially directed combustion-air flow, and at least one fuel nozzle disposed to inject a fuel in the conical hollow space;

a flame tube connected downstream of the premix burner so that heated gases generated in the premix burner are delivered into the flame tube, wherein the flame tube defines a plurality of post-combustion stages in a flow direction therethrough; and, at least one air/fuel mixer disposed at each post-combustion stage to form and introduce an air/fuel mixture into the flame tube.

2. Device according to claim 1, wherein the air/fuel mixers are directed radially with respect to the flame tube.

3. Device according to claim 2, further comprising additional fuel nozzles disposed in a region of the channels along the longitudinal direction.

4. Device according to claim 2, wherein the bodies widen conically in the flow direction at a fixed angle.

5. Device according to claim 2, wherein the bodies are shaped with increasing conicity in the flow direction.

6. Device according to claim 2, wherein the bodies are shaped with decreasing conicity in the flow direction.

* * * * *